US005743307A

United States Patent [19]

Derudder et al.

[11] Patent Number: 5,743,307

[45] Date of Patent: Apr. 28, 1998

[54] HYDRAULIC WARP TENSIONING APPARATUS

[75] Inventors: Carlos Derudder, Heule; Joseph Verschelde, Anzegem, both of Belgium

[73] Assignee: Michel Van De Wiele N.V., Marke, Belgium

[21] Appl. No.: 733,663

[22] Filed: Oct. 17, 1996

[30] Foreign Application Priority Data

Oct. 24, 1995 [BE] Belgium ..... 09500882

[51] Int. Cl.[6] ..... D03D 49/12

[52] U.S. Cl. ..... 139/110; 242/154; 242/155 R; 226/118.2; 226/195; 226/180; 226/189; 29/DIG. 42

[58] Field of Search ..... 139/110, 115, 139/109, 99; 242/154, 155; 226/195, 118.2, 180, 189; 29/DIG. 42

[56] References Cited

U.S. PATENT DOCUMENTS

| | | | |
|---|---|---|---|
| 3,105,524 | 10/1963 | Enloe, Jr. | 139/110 |
| 3,498,337 | 3/1970 | Hindle . | |
| 3,533,574 | 10/1970 | Cooper et al. | 242/154 |
| 3,706,328 | 12/1972 | Dostal | 139/110 |
| 4,341,335 | 7/1982 | Schmid | 226/195 |
| 4,685,190 | 8/1987 | Specht et al. | 29/452 |
| 5,377,892 | 1/1995 | Kimball | 226/92 |

FOREIGN PATENT DOCUMENTS

| | | |
|---|---|---|
| 38 33 685 | 4/1990 | Germany . |
| 93 04 801 | 7/1993 | Germany . |

*Primary Examiner*—Andy Falik

*Attorney, Agent, or Firm*—Merchant, Gould, Smith, Edell, Welter & Schmidt, P.A.

[57] ABSTRACT

A system for bringing ground warp threads under tension on a beam stand comprises first and second rollers on which the ground warp threads run. The first roller is mounted on a support which is movable in relation to the second roller. A mechanism for exerting force on the support is provided whereby the ground warp threads on the beam stand are brought under tension. The mechanism includes a hydraulic element that is connected to a hydraulic pressure vessel by a pipe provided with an apparatus for controlling or regulating the hydraulic fluid.

4 Claims, 1 Drawing Sheet

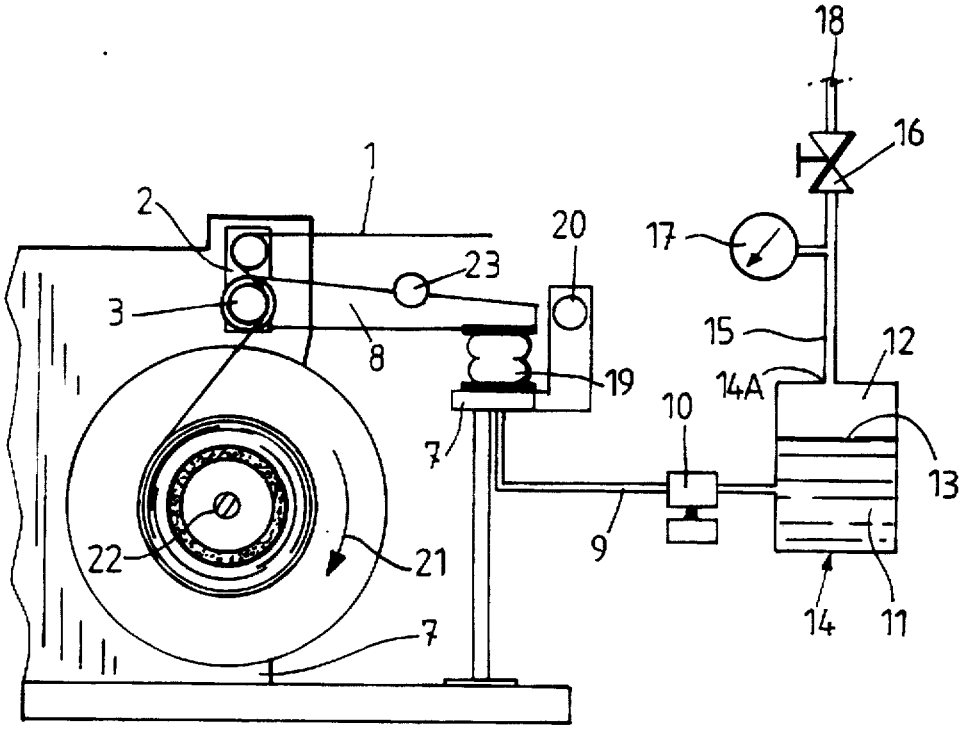
18
16
1
2
20
17
23
3
15
12
8
19
14A
10
7
13
9
22
21
14
11
7

HYDRAULIC WARP TENSIONING APPARATUS

FIELD OF THE INVENTION

This invention relates to a system for bringing ground warp threads under tension on a beam stand comprising:

a) a first roller on which the ground warp threads run;

b) a second roller on which the ground warp threads run;

c) a support on which the first roller is mounted and which is movable in relation to the second roller, and d) a means for exerting force on the support whereby the ground warp threads on the beam stand are brought under tension, the means being a hydraulic element that is connected to a hydraulic pressure vessel, whereby between the hydraulic element and the hydraulic pressure vessel there is a means for controlling and/or regulating the hydraulic fluid.

BACKGROUND OF THE INVENTION

According to the current prior art a system for bringing ground warp threads under tension on a beam stand of a weaving machine, more specifically of a carpet weaving machine, works as follows:

the yarn layer goes around a first roller;

that first roller can rock around its roller shaft;

that roller shaft comprises a lever upon which a bar provided with a support plate is suspended on which weights can be laid;

the entire bar provided with the support plate and weights, together with the length of the lever, determine a moment that is applied to the roller shaft;

the roller device converts this moment into a force on the yarn layer.

Another solution includes in replacing the weight lever system by a spring lever system. Alternative systems are being sought in pneumatic springs that are represented as a pneumatic cylinder (German patent application 3833685) or as a pneumatic spring (German utility model 93 04 801.7).

Each of the aforementioned systems has its specific disadvantages.

The system with weights is the most tested and until now the only available one on the market. The great advantage is the easy adjustability (adding or removing a weight) and the immediate visual observance of the number of weights and therefore of the yarn tension. The great disadvantage however is that with high shot rates the weights can start to rock dangerously and as such have to be kept still by rather more costly means. Furthermore a weight holder can break which leads to dangerous situations. Protection is therefore necessary. A great disadvantage that should also be mentioned is that, for beam changing or longer non-working period of the weaving machine, the yarn tension can be removed by either taking off the weights, which is a rather primitive method, or by letting the weights descend onto a fixed support, which can only occur by driving the beam by an electric (or other) motor. In the latter case the motor must always be dimensioned for winding up the beam under load, which therefore requires a great over dimensioning of the motor in relation to its normal function of unwinding the beam.

A spring-loaded system has the great advantage that it can be made compact and elegant. The structural design requires some complexity for:

the practical design of a device for pre-tensioning very stiff springs, and for removing the yarn tension.

Furthermore the adjustment is very complex. Either the spring tension is adjusted, which gives some practical disadvantages given that the dynamic behavior (thus changes in its natural frequency) of the system can change with the pre-tensioning, or the lever length is adjusted for a fixed spring force. In both cases, a great disadvantage is that the user no longer has any visual relationship between yarn tension and adjustment of the spring system.

With the pneumatic cylinder or the pneumatic spring a number of the disadvantages of the aforementioned systems are avoided. The compactness, safety and so called easy adjustment by pressure regulation appear to be obvious advantages. Such air systems have the disadvantage that their natural frequency lies close to the shot rate of the machine, whereby these systems become very critical in dynamic behavior. An adjustment of the air pressure, referred to by the user as adjustment of the yarn tension, will sometime appear difficult since the fundamental mode of a pneumatic system is dependent on the pressure. Furthermore, the absence of any damping leads to undesired behavior, namely resonance. The great advantage of such a system is that the yarn tension can be removed by removing the air pressure. Over dimensioning of the (electric) motor for unwinding the beam is therefore not necessary.

With beam strands for weaving machines, in particular carpet weaving machines, a system of weights, or mechanical or pneumatic springs is usually not sufficient. Damping is often necessary. For obtaining such a damping, it is known to use a separate damper between the lever and the frame.

SUMMARY OF THE INVENTION

The object of the invention is a system for combining the tensioning of yarns with a damping system in the form of a hydropneumatic element or spring, whereby all the disadvantages of the aforementioned known systems are avoided, while the advantages of pneumatic springs are retained.

The system according to the invention for bringing ground warp threads under tension comprises:

a) a first roller on which the ground warp threads run;

b) a second roller on which the ground warp threads run;

c) a support on which the first roller is mounted and which is movable in relation to the second roller, and d) a means for exerting force on the support whereby the ground warp threads on the beam stand are brought under tension, the means being a hydraulic element that is connected to a hydraulic pressure vessel, whereby between the hydraulic element and the hydraulic pressure vessel there is a means for controlling and/or regulating the hydraulic fluid.

The means for controlling is preferably a valve, which is preferably adjustable and/or controllable.

According to an embodiment, the pressure vessel comprises a membrane that forms a separation between the fluid and a gas, whereby the pressure of the gas is regulated in order to regulate the pressure in the pressure vessel.

According to another embodiment, the support supports a sensor for acting on the position of the valve and/or acting on the position of a pressure valve in order to regulate the pressure of the pressure vessel.

Other characteristics and details of an embodiment of a system according to the invention will appear from the following description, in which reference is also made to the attached drawing.

BRIEF DESCRIPTION OF THE DRAWING

The single FIGURE is a schematic view of a system according to the present invention.

DESCRIPTION OF THE PREFERRED EMBODIMENT

A lever 8 is attached to the roller shaft 3 of roller device 2. Bellows 19 or a hydraulic cylinder are mounted between a frame 7 and the lever 8. The bellows or hydraulic cylinder are filled with a fluid, for example thin oil. This fluid or liquid can flow through pipe 9 to the pressure vessel 14 and flow back from pressure vessel 14 to bellows 19 or hydraulic cylinder. An adjustable and controllable valve 10, preferably a butterfly valve, is provided in pipe 9. The damping, in the present case a viscous damping, can be regulated and controlled by the valve 10. The pressure in bellows 19 determines the tension in the yarns 1 by exerting a moment via lever 8 on roller shaft 3. This pressure is now regulated in pressure vessel 14. This pressure vessel 14 consists of the fluid 11 and air 12 separated by the membrane 13. The membrane 13 defines in the pressure vessel 14 two separate chambers, a first chamber containing the fluid or liquid 11, while the second chamber contains air 12 (or possibly another gas). The pressure vessel is provided with an opening 14A so as to connect the second chamber, via a pipe 15, to a means regulating the pressure of the air in order to regulate the pressure in the pressure vessel. The pressure of the air 12 is determined by regulating the air from a central compressor 18 over a pressure valve 16 provided with a manometer 17.

The yarn 1 runs first on the first roller 2 and then on a second roller 2A, the lever 8 being movable with respect to the second roller.

A sensor 23 is mounted on the lever 8. The sensor 23 regulates the removal of yarn 1 from the beam 21 by motor 22 in such manner that the lever 8 always remains in a same position. This sensor will therefore in most cases be a linear sensor. The sensor 20, which is for example attached to the frame 7, is a safety sensor for stopping the working of the motor in emergency cases.

The signal from the sensor 23 can also be used for both acting on the valve 10 and on the pressure valve 16 so as to adjust the position of each of said valves. For example, the position of the valve 10 is adjusted between an open position and an off position. Such adjustment can be useful with start and stop conditions or for adjustment to maximum damping (lowest possible natural frequency of the system).

What I claim is:

1. A system for bringing ground warp threads under tension on a beam stand comprising:

a) a first roller on which the ground warp threads run;

b) a second roller on which the ground warp threads run;

c) a support on which said first roller is mounted and which is movable in relation to the second roller; and d) a hydraulic element exerting force on said support whereby the ground warp threads on the beam stand are brought under tension, said hydraulic element being connected to a hydraulic pressure vessel by means of a pipe, said pipe including an adjustable and controllable hydraulic fluid valve allowing regulation and control of hydraulic damping in said pipe.

2. The system of claim 1, in which the support supports a sensor and in which said hydraulic fluid valve has a position comprised between an open position and an off position which is adjusted by the sensor supported by the support.

3. The system of claim 1, in which the pressure vessel comprises a membrane defining two separate chambers, a first chamber containing a hydraulic fluid, while the second chamber containing a gas, said vessel further comprising an opening so as to connect the second chamber to a pressure valve, the position of which is adjustable, and in which said support supports a sensor acting on the position of the pressure valve in order to regulate the pressure in the pressure vessel.

4. The system of claim 1, in which the support comprises a lever which exerts a moment on the first roller, whereas at least one bellow is connected to the hydraulic pressure vessel and exerts a force on said lever.

* * * * *